US005577685A

United States Patent [19]

Junk

[11] Patent Number: 5,577,685

[45] Date of Patent: Nov. 26, 1996

[54] APPARATUS FOR WINDING A CONTINUOUSLY INCOMING PAPER WEB

[75] Inventor: Dieter Junk, Kreuztal, Germany

[73] Assignee: Voith Sulzer Finishing GmbH, Krefeld, Germany

[21] Appl. No.: 428,291

[22] Filed: Apr. 25, 1995

[30] Foreign Application Priority Data

May 2, 1994 [DE] Germany ..... 44 15 324.4

[51] Int. Cl.[6] ..... B65M 18/16; B65M 19/28

[52] U.S. Cl. ..... 242/547; 242/526; 242/533

[58] Field of Search ..... 242/526, 527, 242/527.2, 532.2, 532.3, 533, 533.1, 533.7, 547

[56] References Cited

U.S. PATENT DOCUMENTS

| | | | |
|---|---|---|---|
| 2,984,426 | 5/1961 | Johnson . | |
| 3,877,654 | 4/1975 | Randpalu et al. | 242/533.1 |
| 4,179,330 | 12/1979 | Page . | |
| 4,196,865 | 4/1980 | Patriksson | 242/532.2 |
| 4,695,004 | 9/1987 | Grossmann et al. | 242/532.3 |
| 4,744,526 | 5/1988 | Kremar | 242/533 |
| 5,184,787 | 2/1993 | Holzinger et al. . | |
| 5,370,327 | 12/1994 | Adamski | 242/533.1 |
| 5,431,357 | 7/1995 | Rüegg | 242/526 |

FOREIGN PATENT DOCUMENTS

| | | |
|---|---|---|
| 1197129 | 11/1959 | France . |
| 3332827 | 4/1984 | Germany . |
| 4401959 | 7/1994 | Germany . |
| 4-164758 | 6/1992 | Japan . |
| 473052 | 7/1969 | Switzerland . |

*Primary Examiner*—John P. Darling
*Attorney, Agent, or Firm*—Darby & Darby

[57] ABSTRACT

An apparatus for winding a continuous incoming paper web on a reel-spool. The apparatus includes a fixed winding station, a fixed take-up station and a contact pressure roll. The roll continuously lies against the circumference of a secondary reel during the winding process. The web is conveyed so that it enters continuously into the inlet gap without looping.

10 Claims, 2 Drawing Sheets

Fig.1
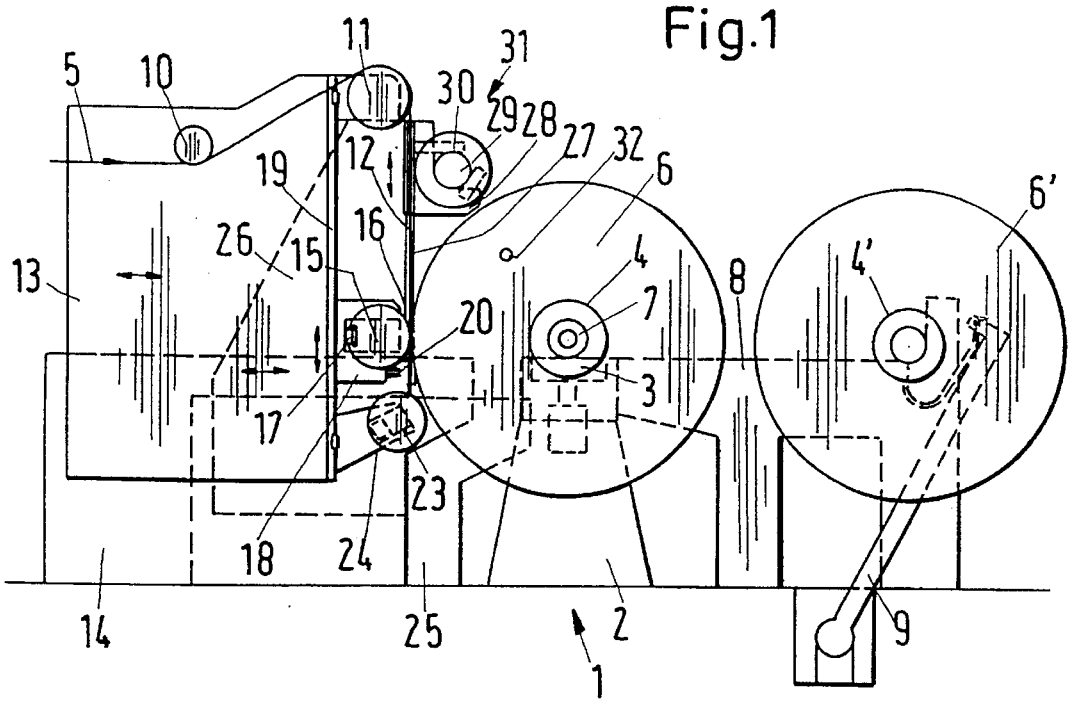
Fig.2
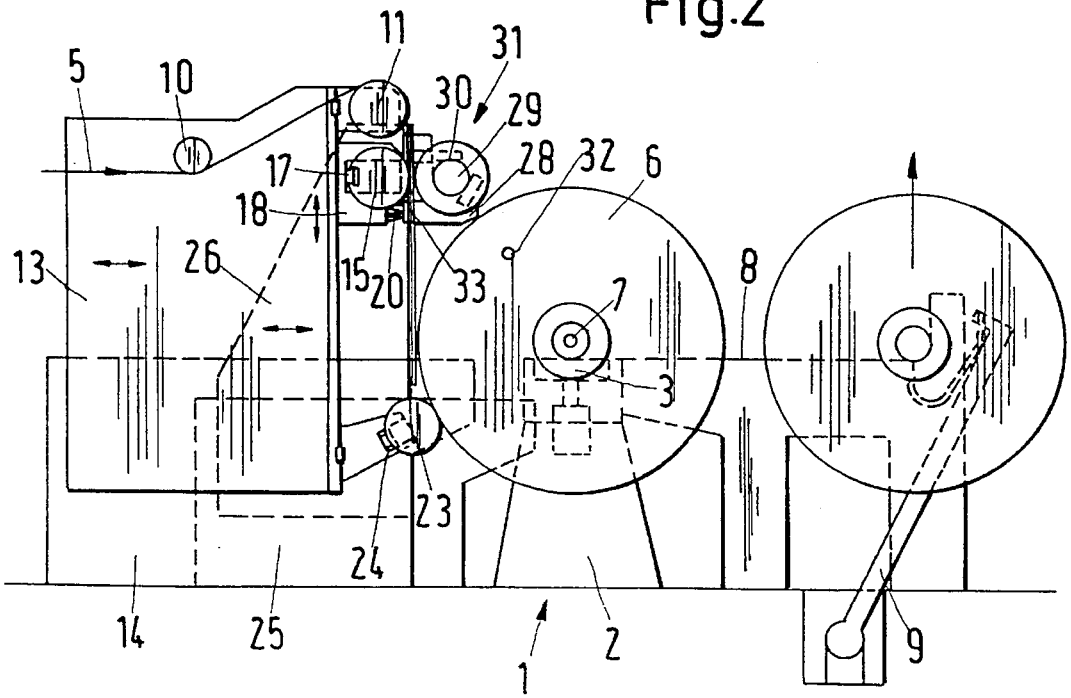
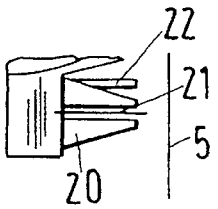
Fig.6

APPARATUS FOR WINDING A CONTINUOUSLY INCOMING PAPER WEB

BACKGROUND OF THE INVENTION

1. Field of the Invention

The present invention relates to an apparatus for winding a continuously incoming paper web on a reel-spool. More specifically, the present invention relates to an apparatus for winding a continuously incoming paper web including a winding station, a take-up station, a transfer apparatus and a contact pressure roll.

2. Discussion of the Related Art

In German Reference DE 33 32 827 A1 two bearings are displaced by 180° from one another and are disposed on a rotary head. Each bearing is associated with one reel-spool. These bearings are used alternately as a winding station and a take-up station. A separate contact pressure roll is associated with each bearing. This winding apparatus is suitable only for relatively small rolls, but not for long and heavy rolls, such as are required, for example, in paper technology. Furthermore, it is difficult to accommodate the two contact pressure rolls with their contact pressure mechanism on the rotary head.

Another known winding apparatus is German Reference DE 41 04 635, which also works with a rotary head. The web is conveyed over a deflection roll, which serves as a contact pressure roll in the area of the take-up station. A second contact pressure roll is located in the winding station. During the transfer of the secondary reel from the take-up station to the winding station, one contact pressure roll acts first on the reel and then the other contact pressure roll act on the reel, with the result that the surround angle at which the web contacts the deflection roll, and the angular position at which the contact pressure force acts on the reel, vary to a considerable extent. This results in changes of the contact pressure between the contact pressure roll and the reel, as well as in changes in the web tension. At the desired winding speeds, these changes can not be equalized sufficiently, and as a result, the reel is negatively affected, especially in the wind-up phase.

SUMMARY OF THE INVENTION

An object of the present invention is to provide a winding apparatus which has good reel qualities even during the wind-up phase for large and heavy reels.

In accordance with a preferred embodiment of the present invention, the winding station is disposed so as to be fixed in place so that even very large and heavy reels can be created in the winding station. Sufficient space is available for a contact pressure roll with its associated mechanism. The web runs free of the circumference of the reel and without looping toward the contact pressure roll. As a result, there is a clear separation of the two adjustment possibilities, namely the web tension and the contact pressure exerted by the contact pressure roll. Since the contact pressure roll acts continuously from the beginning of the winding process up to the winding station, the conditions of contact pressure can be maintained practically over the entire winding period, which results in good reel qualities.

The contact pressure roll is guided so that it runs with a second reel-spool, thus assuring that the contact pressure roll maintains its position relative to the reel-spool during the entire winding process.

In a further advantage, according to the present invention, two guide tracks for the second reel and for the contact pressure roll are matched to the course of the web, which yields an especially simple design.

According to a further advantage, the motions during a roll change are restricted to vertical and horizontal components. Thus, the weight of the contact pressure roll has no effect on the contact pressure.

The reel-spool bearing slide and roller-bearing slide can be coupled to facilitate guidance of the contact pressure roll when the secondary reel is moved to the winding station by means of a transfer slide so that the secondary reel can be deposited on a stationary winding station.

A further advantage of the present invention is in an especially sensitive control of the contact pressure between the contact pressure roll and the reel, due to controlling the distance between the contact pressure roll and the reel. This distance control means that the force transmitter will see the same conditions in all operating positions.

The auxiliary contact pressure roll acts only at the end of the winding process, where a precise control of web tension and contact pressure is much less important than at the beginning of the winding process.

By quickly returning the contact pressure roll to the take-up station the time during which the auxiliary contact pressure roll acts is relatively short.

The arrangement of the separation apparatus on the movable support slide has the advantage that it separates the web between the winding station and the second reel-spool, so that the beginning of the trailing web section is wound up in advance over the entire width on the second reel-spool. The separation apparatus is connected to the bearing for the contact pressure roll, so that the separation apparatus will not impede the motion of the contact pressure roll.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIGS. 1 through 5 show an the apparatus according to the present invention in various operating positions; and FIG. 6 shows, on an enlarged scale, the separation apparatus.

DETAILED DESCRIPTION OF THE PREFERRED EMBODIMENTS

Figure 3:
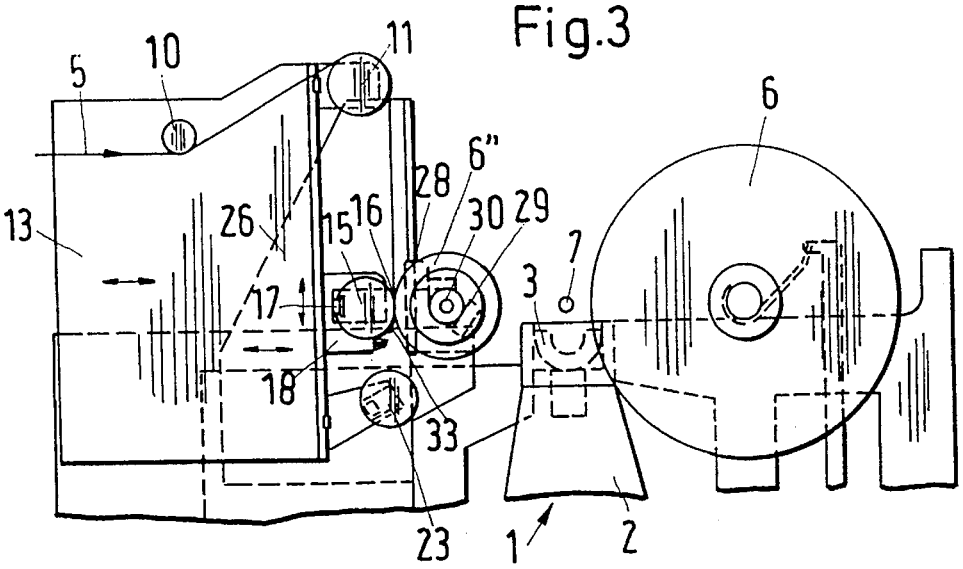

Referring now to FIG. 1, an apparatus in accordance with the present invention is illustrated. The apparatus includes a winding station 1 which has stationary pillow blocks 2. Vertically adjustable bearings 3 are mounted on blocks 2. Beatings 3 support a spool 4. A web 5 is wound on spool 4, which is rotatably driven by drive 7. The web 5, which is wound on spool 4, will be referred to as "the primary reel 6". Rails 8 are disposed adjacent to bearings 3. A completed primary reel 6' can be removed from the winding station 1 by means of drag-arms 9, which transport spool 4 over rails 8.

The web 5 is conveyed to the primary reel 6 over a guide roll 10, which can be, for example, a wide stretch roll, and a deflection roll 11, in such a fashion that the web section 12, which immediately precedes the primary reel 6, runs vertically and tangentially to the reel circumference. So that this condition is preserved as the reel diameter increases, the guide roll 10 and the deflection roll 11 are mounted on a support slide 13, which can move horizontally on a chassis 14. For this purpose, a control system (not shown) is provided, whose function is to assure that the fight front edge of the support slide 13 is maintained at a constant predetermined distance from the circumference of the primary reel 6.

Support slide 13 also carries a contact pressure roll 15, which forms an inlet gap 16 with respect to the primary reel 6, and which can be pressed against the circumference of the reel by means of a short-stroke force transmitter 17. This control of the adjustment force for the contact pressure can be effected, for example, electro-pneumatically. The contact pressure and the web tension can be chosen to create a reel having optimum properties.

The contact pressure roll 15, including the short-stroke force transmitter 17, is disposed on a roller-bearing slide 18, which can be moved along a vertical guide track 19 formed on the support slide 13. A separation apparatus 20 is supported on the roller-bearing slide 18 below the contact pressure roll 15. Separation apparatus 20 has a separation knife 21 and adjoining blow dies 22. An auxiliary contact pressure roll 23 is disposed on the support slide 13 below contact pressure roll 15. Auxiliary contact pressure roll 23 has an adjustment apparatus 24, which functions similarly to transmitter 17.

A horizontally movable transfer slide 26 is disposed on a second chassis 25. Slide 26 carries a guide track 27, which is disposed parallel to guide track 19. A reel-spool bearing slide 28 can move vertically on guide track 27. Slide 28 carries a bearing 29 for a secondary reel-spool 30. In a position shown in FIG. 1, bearing 29 forms a take-up station 31 for the secondary reel-spool 30. A rotary drive 32 for this secondary reel-spool 30 is fixedly disposed on a side of the apparatus which is located opposite drive 7, and is connected to the secondary reel-spool through an articulated shaft.

The reel-spool bearing slide 28 and the roller-bearing slide 18 have a coupling 33, by means of which the slides can be coupled in the take-up station 31, with a positive interlock in the vertical direction, but being movable in the horizontal direction, e.g., by hydraulically movable pins. The axes of the second reel-spool 30 and of the contact pressure roll 15 lie in the horizontal plane, which moves slowly downward.

Referring now to FIGS. 1 through 5, the various successive operating positions of the winding apparatus will be described.

FIG. 1 shows the normal winding operation shortly before the primary reel 6 has reached its maximum reel diameter. The second reel-spool 30 is already situated in the take-up station 31. The preceding reel 6' has reached the take-off position.

FIG. 2 shows the operating position shortly after initiation of a roll change, i.e., when the primary reel 6 has almost reached its desired diameter. The auxiliary contact pressure roll 23 is pressed against the circumference of the primary reel 6 by means of its adjustment apparatus 24. Immediately afterwards, the roller-bearing slide 18 is run upwardly in relatively fast motion to the level of the take-up station 31, where it is connected to the reel-spool bearing slide 28 by means of coupling 33. The second reel-spool 30 in the meantime has already been brought, by drive 32, to the circumferential speed corresponding to the speed of the web 5. During these steps, the support slide 13 and the transfer slide 26 can be fixed in their most recently assumed position. The distance control is briefly disabled, and is activated again only when contact is made between the contact pressure roll 15 and the second reel-spool 30, while the transfer slide 26 at first continues to remain fixed.

Immediately afterwards, the web is suddenly separated by knife 21 of the separation apparatus 20. The end of the leading web section is wound on the primary reel 6. The beginning of the trailing web section wraps around the second reel-spool 30, supported by the blow dies 22. The sudden web separation and the simultaneous wind-up of the full web width in a few hundredths of a second is desirable for high-speed roll changes and reduces the waste portion of the web. Instead of being supported by the blow die 22, the initiation of the winding process on the second reel-spool 30 can also be supported by moistening the second reel-spool 30 and/or by a guide cup that is equipped with air nozzles, which can be swung in and out to effect the initial wrap of web 5 around the second reel-spool 30.

The secondary reel 6" disposed in the take-up station 31 has, from the very beginning of the winding process, the optimal reel parameters because contact pressure roll 15 is immediately in contact with web 5. The second reel-spool 30 and the contact pressure roll 15 coupled to it can be lowered in a precise slow motion to the level of the winding station 1. The primary reel 6 has been removed from the winding station by means of the drag arms 9 after bearing 3 has been lowered (see FIG. 3). For this purpose, one of the reciprocating drives of the roller-bearing slide 18 and the reel-spool bearing slide 28 should be of a precise type, e.g. in the form of spindle-stroke elements, while the reciprocating drive of the other slide can be designed to be less precise, e.g., in the form of a cable-pull cylinder or an air motor, because it is coupled to the more precise slide. It is preferred that the reciprocating drive for the reel-spool bearing slide be designed with precision. Because of the slow lowering motion, the web tension control, which is here effected by means of drive 32, has sufficient time to make the adaptations that are necessary with each change of the running lengths of the web. The optimal winding process consequently is not impaired. The transfer slide 26 can be held stationary during this downward motion, while the support slide 13 follows the increasing radius of the secondary reel 6", in dependence on the distance control system.

As soon as the roller-bearing slide 18 and the reel-spool bearing slide 28, which are coupled together, have reached the level of the winding station 1, the fixation of the position of the transfer slide 26 is released, and its drive is switched in the direction toward the winding station 1. Due to the above-mentioned distance control, the support slide 13 follows the transfer slide 26, reduced by the amount of the increase of the radius of the secondary reel 6". Any slight synchronization errors that may occur due to the horizontal drives of the two slides will have no detrimental effect on the winding process, because the sensitive short-stroke force transmitter 17, which is acting horizontally, will compensate for any errors.

Figure 4:
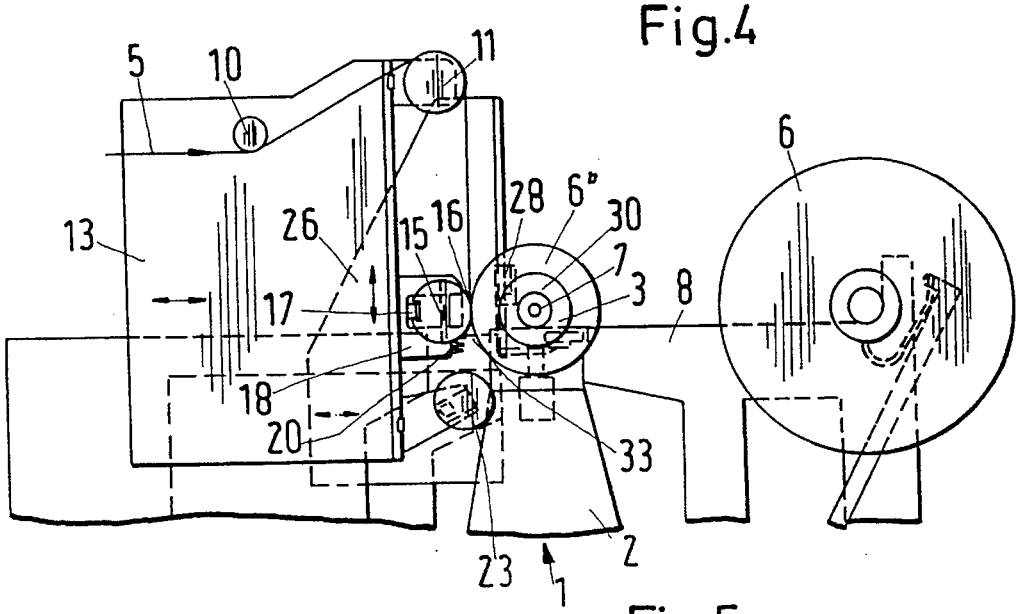

As soon as the second reel-spool 30 has reached the winding station 1, the bearings 3 are raised and are sealed in the usual manner. The secondary reel 6" now has a solid mounting for the further winding process, as shown in FIG. 4. The reel-spool 30 is connected to the drive 7, so that the drive 32 can be recoupled. Since the web tension is also set by means of the drives, a corresponding transfer of control takes place from drive 32 to drive 7.

Figure 5:
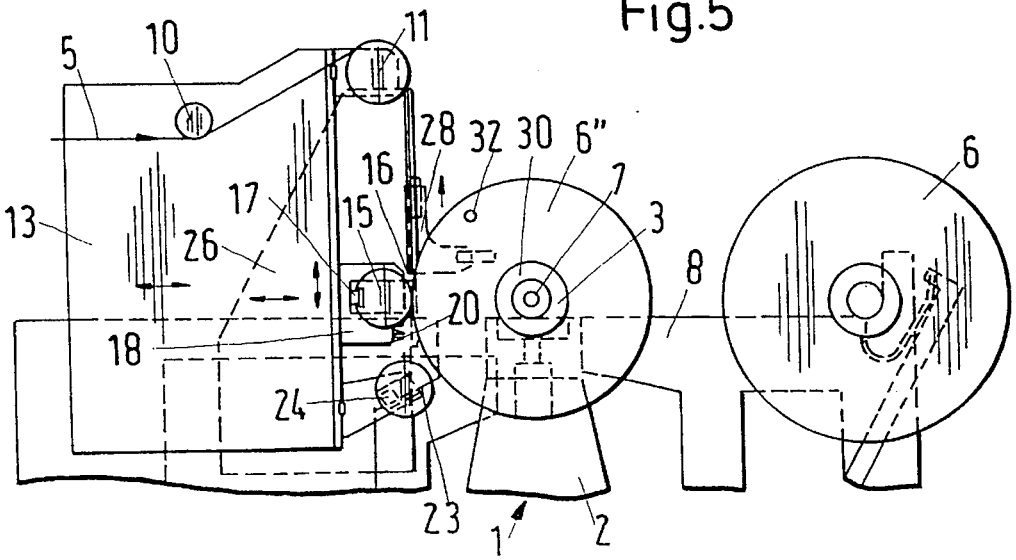

As soon as the reel diameter of the secondary reel 6" has become larger, as shown in FIG. 5, the reel-spool bearing slide 28, which has been moved left by means of the transfer slide 26, can be raised up to the take-up station 31, and, during this process, can be moved past the second reel-spool 30. It is suitable for the transfer slide 26 to be moved together with the support slide 13, and for the reel-spool bearing slide 28 to be moved upward to a defined position. This assures the proper disposition of all components for the next roll change.

Numerous modifications of the embodiment described above are possible without departing from the basic idea of the invention. For example, drive 32 can also be replaced by a motor moving along with the reel-spool bearing slide 28. The individual working steps can follow one another fully automatically. Instead of two chassis 14 and 25, a common chassis with separate levels can be used. The horizontal drives can be designed in a conventional manner, e.g., hydro- or electro-mechanical systems. To compensate for bending effects and/or influences on the contact pressure pattern of the web width, e.g. in the case of transverse profile defects, the contact pressure roll 15 can be designed as a bend-compensation roll. To influence the web tension, a motor/generator drive can be used. A drive of the contact pressure roll 15 can be used to keep the speed in synchronism during the phase initiated by the reel.

Having described the presently preferred exemplary embodiment of a new and improved apparatus for winding a continuously incoming paper web, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. An apparatus for winding a continuously incoming paper web on a reel-spool, said apparatus comprising:

a winding station having means for winding a first reel-spool;

a cutting member to cut said incoming paper web into a trailing web section and a leading web section;

a take-up station having means for storing a second, empty reel-spool, on which said trailing web section is wound;

a transfer apparatus having means for transporting said second reel-spool from said take-up station to said winding station; and a contact pressure roll having means for contacting a circumference of a second reel being wound on said second reel-spool continuously, from the initiation of being wound to being transferred to the winding station, wherein said contact pressure roll together with the circumference of the second reel define an inlet gap, into which the paper web enters substantially continuously without looping, the transfer apparatus has a first guide track for moving said second reel, and wherein said contact pressure roll is movable on a second guide track, which is parallel to said first guide track, from a finished primary reel in said winding station to said second reel in said take-up station, and said contact pressure roll being movable to said winding station together with said the second reel.

2. The apparatus according to claim 1, wherein said contact pressure roll is movable in a plane of movement that is parallel to a plane of movement defined by an axis of said second reel-spool.

3. The apparatus according to claim 2, further comprising a deflection roll being disposed in contact with said incoming web so that after said web contacts said deflection roll, said web runs parallel to the first and second guide tracks.

4. The apparatus according to claim 3, wherein said second reel-spool carries said second reel and said contact pressure roll when the roll is transferred to said winding station, said second reel-spool being first lowered vertically from said take-up station to said winding station and then being moved horizontally, so that the axis of the contact pressure roll is disposed in substantially the same horizontal plane as the axis of said second reel-spool, said axis of said contact pressure roll being moved horizontally with respect to said axis of said second reel-spool to account for the increase of the second reel diameter.

5. The apparatus according to claim 4, wherein said transfer apparatus has a vertically movable reel-spool bearing slide, said contact pressure roll is carried by a vertically movable roller-bearing slide, and the two slides can be coupled to synchronize their respective vertical motion.

6. The apparatus according to claim 5, wherein said transfer apparatus has a horizontally movable transfer slide to transfer said second reel into said winding station.

7. The apparatus according to claims 6, wherein said contact pressure roll is loaded by a force transmitter, which is carried by a horizontally movable support slide and wherein, by means of a control system, said support slide is held continuously at a predetermined distance from the circumference of said second reel.

8. The apparatus according to claim 7, wherein an auxiliary contact pressure roll is disposed outside the path of said contact pressure roll and is pressed against the primary reel shortly before separation of said web.

9. The apparatus according to claim 8, wherein said contact pressure roll returns from said winding station to said take-up station faster than a motion of said transfer apparatus from said take-up station to said winding station, after the auxiliary contact pressure roll is pressed into contact against said primary reel.

10. The apparatus according to claim 9, further comprising a separation apparatus for the web being connected to said movable support slide.

* * * * *

UNITED STATES PATENT AND TRADEMARK OFFICE

CERTIFICATE OF CORRECTION

PATENT NO. : 5,577,685

DATED : November 26, 1996

INVENTOR(S) : Dieter JUNK

It is certified that error appears in the above-indentified patent and that said Letters Patent is hereby corrected as shown below:

Title page, [30], Foreign Application Priority Data, change "44 15 324.4" to --P 44 15 324.4--.

Signed and Sealed this

Twenty-ninth Day of April, 1997

*Attest:*

*Attesting Officer*

BRUCE LEHMAN

*Commissioner of Patents and Trademarks*